US005259623A

United States Patent [19]

Kanelos, Sr.

[11] Patent Number: 5,259,623

[45] Date of Patent: Nov. 9, 1993

[54] DRIVER EDUCATION BOARD GAME

[76] Inventor: James C. Kanelos, Sr., 28 Harrise Dr., Linglestown, Pa. 17112

[21] Appl. No.: 54,253

[22] Filed: Apr. 30, 1993

[51] Int. Cl.[5] ..... A63F 3/00

[52] U.S. Cl. ..... 273/249; 273/243

[58] Field of Search ..... 273/242, 243, 246, 248, 273/249, 251, 252, 254, 283, 284

[56] References Cited

U.S. PATENT DOCUMENTS

| | | | |
|---|---|---|---|
| 4,136,879 | 1/1979 | Andrew et al. | 273/243 |
| 4,216,966 | 8/1980 | MacRae . | |
| 4,341,388 | 7/1982 | Carter . | |
| 4,953,871 | 9/1990 | Antwi . | |
| 5,002,283 | 3/1991 | Langham et al. . | |
| 5,050,887 | 9/1991 | Kemp . | |

FOREIGN PATENT DOCUMENTS

| | | | |
|---|---|---|---|
| 231281 | 2/1959 | Australia | 273/243 |
| 801964 | 9/1958 | United Kingdom | 273/243 |
| 2203957 | 11/1988 | United Kingdom | 273/243 |

*Primary Examiner*—William Stoll
*Attorney, Agent, or Firm*—Richard C. Litman

[57] ABSTRACT

A board game teaching traffic laws and regulations provides a peripheral playing path about the perimeter of a rectangular board and further inwardly located paths. The inwardly located paths are provided for the purpose of various examinations or tests to be undertaken by each player during the course of the game. The first player to successfully complete the written examination, eye examination, and road test portions of the game is declared the winner. However, other questions and requirements must be satisfactorily responded to during the portion of play which takes place along the peripheral playing path of the game board.

9 Claims, 6 Drawing Sheets

FIG. 5A
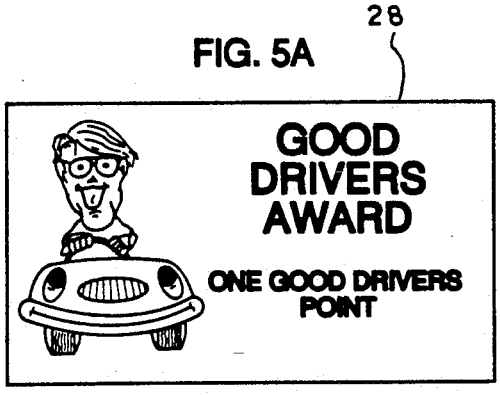
FIG. 5B
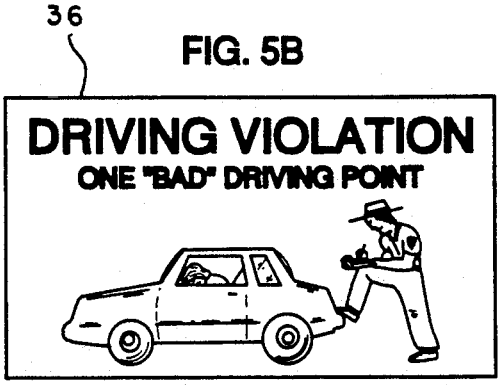
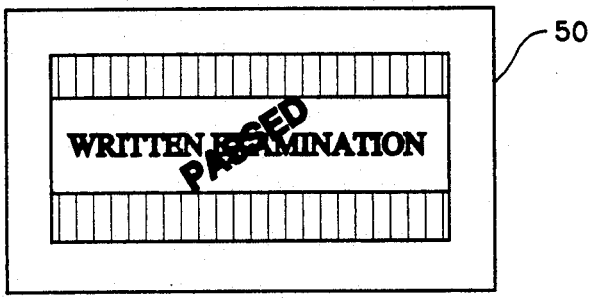
FIG. 6A
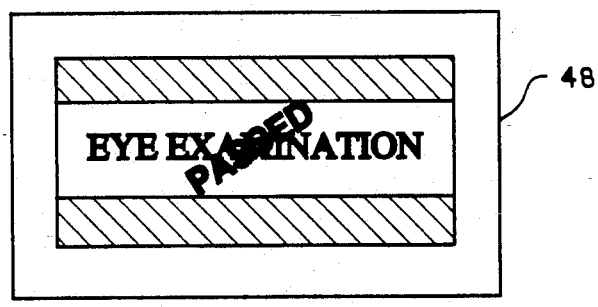
FIG. 6B
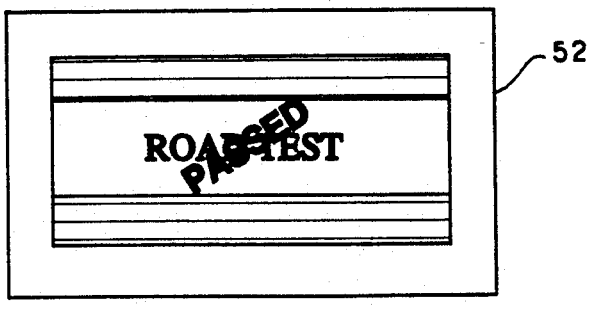
FIG. 6C

DRIVER EDUCATION BOARD GAME

FIELD OF THE INVENTION

The present invention relates generally to games and amusement devices, and more specifically to a board game which provides educational features relating to automobile driving knowledge and skills, as well as providing for entertainment.

1. Background of the Invention

As streets and roadways become ever more crowded with vehicle traffic, particularly in major metropolitan areas, it is imperative that strict adherence to traffic laws and regulations be practiced. Traffic situations frequently occur in which there is little or no margin for error, and the violation of a traffic law or regulation by one driver can lead to a multiple car accident. This is especially true in "rush hour" situations, where many drivers fail to allow additional time for adverse traffic situations and attempt to save time by means of excessive speed, following too closely, failing to come to a full stop when required, etc.

Moreover, many drivers have become lax in their habits relating to the following of traffic laws and regulations, and particularly in rural areas many drivers have become complacent due to the lack of other traffic. Unfortunately in many areas, law enforcement personnel place greater emphasis upon the enforcement of more lucrative aspects of traffic regulation (e.g., checking for expired registration) which have little or nothing to do with safety, rather than enforcing the safety aspects of the motor vehicle code. In many areas, most traffic citations are issued as a result of an accident, rather than as a consequence of a law enforcement officer observing an unsafe driving maneuver. As a result of the above trends, many drivers are unaware of, disregard, or have forgotten many of the basic concepts, rules, and regulations of traffic safety.

Initial and remedial training courses for student and experienced drivers are generally in a classroom setting, and for whatever reasons, are not generally particularly interesting or memorable. This is a tragic situation, considering that the information provided by such courses can literally be life saving under certain circumstances. However, due to the content and method of delivery of the information in many, if not most, such courses, many drivers will only attend if forced to do so in lieu of the payment of a fine or other penalty.

The need arises for a game for teaching vehicle traffic rules, regulations, and general driver knowledge, which game is enjoyable for those persons involved. The game must be relatively simple in order to be playable and enjoyable by persons younger than the minimum driving age in order to teach those younger persons the rules, regulations and procedures well in advance of their beginning driver training. Yet the game must also be sufficiently complex and realistic as to be challenging to experienced drivers and adult players.

2. Description of the Prior Art

U.S. Pat. No. 4,216,966 issued to Thomas H. MacRae on Aug. 12, 1980 discloses a Board Game Simulating Drunk Driving. The game is directed strictly to educating the players on the effects of alcohol consumption and driving, and neither the rules nor the method of play deal with any other aspects of driving, as does the present game.

U.S. Pat. No. 4,341,388 issued to John Carter on Jul. 27, 1982 discloses a Driving Game Board Apparatus.

While the game includes instructions and remarks relating to various traffic laws and rules, the winner of the game is determined by the first player to arrive at a certain point on the game board. No intermediate tests are required, as in the present game.

U.S. Pat. No. 4,953,871 issued to Samuel Antwi on Sep. 4, 1990 discloses a Traffic Board Game in which players selectively move their playing pieces so as to arrive at specific points on the game board. Each player starts with a given number of points, and points may be subtracted during the course of play in accordance with the rules of the game. The player arriving at his/her destination with the greatest number of points remaining, is the winner. While questions are asked of the players during the course of the game, no organized testing of various aspects of driving knowledge or other abilities is provided, as in the case of the present game.

U.S. Pat. No. 5,002,283 issued to Norma Langham et al. on Mar. 26, 1991 discloses a Defensive Driving Question And Answer Game Having Separate Interchange Bridge Section. Numerous steps are involved in order to achieve the goal of the game, and much of the outcome of the game is based upon the reflexes of the players involved in declaring certain situations. No organized testing is disclosed, as in the manner of the present game.

Finally. U.S. Pat. No. 5,050,887 issued to Douglas w. Kemp on Sep. 24, 1991 discloses a Traffic Simulation Board Game Apparatus including electronic timing and playing path randomizing means. The object is to reach a predetermined point on the game board in the least amount of time. While game cards are provided, they relate only to directions and instructions, and do not require any knowledge of traffic laws or regulations on the part of the players.

None of the above noted patents, taken either singly or in combination, are seen to disclose the specific arrangement of concepts disclosed by the present invention.

SUMMARY OF THE INVENTION

By the present invention, an improved board game for the teaching of traffic laws, rules and regulations is disclosed.

Accordingly, one of the objects of the present invention is to provide an improved board game which includes a peripheral playing path as well as inwardly positioned playing paths on the game board.

Another of the objects of the present invention is to provide an improved board game in which the numerical value of a positional move is determined by chance means, such as a die or dice.

Yet another of the objects of the present invention is to provide an improved board game which requires players to attempt to correctly answer questions relating to traffic laws and regulations during the course of play.

Still another of the objects of the present invention is to provide an improved board game which requires a player to pass through a series of examinations or tests before that player can win the game.

A further object of the present invention is to provide an improved board game which requires a player to traverse a specific inwardly located path on the game board while taking each examination or test.

A final object of the present invention is to provide an improved board game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 5A is a view of the front side of a "Good Drivers Award" card used during the course of play of the present game.

FIG. 5B is a view of the front side of a "Driving Violation" card used during the course of play of the present game.

FIG. 6A is a view of the front side of a "Written Examination Passed" card awarded upon completion of that portion of the play of the present game.

FIG. 6B is a view of the front side of an "Eye Examination Passed" card awarded upon completion of that portion of the play of the present game.

FIG. 6C is a view of the front side of a "Road Test Passed" card awarded upon completion of that portion of the play of the present game.

Similar reference characters denote corresponding features consistently throughout the several figures of the attached drawings.

DETAILED DESCRIPTION OF THE PREFERRED EMBODIMENT

Figure 1A:
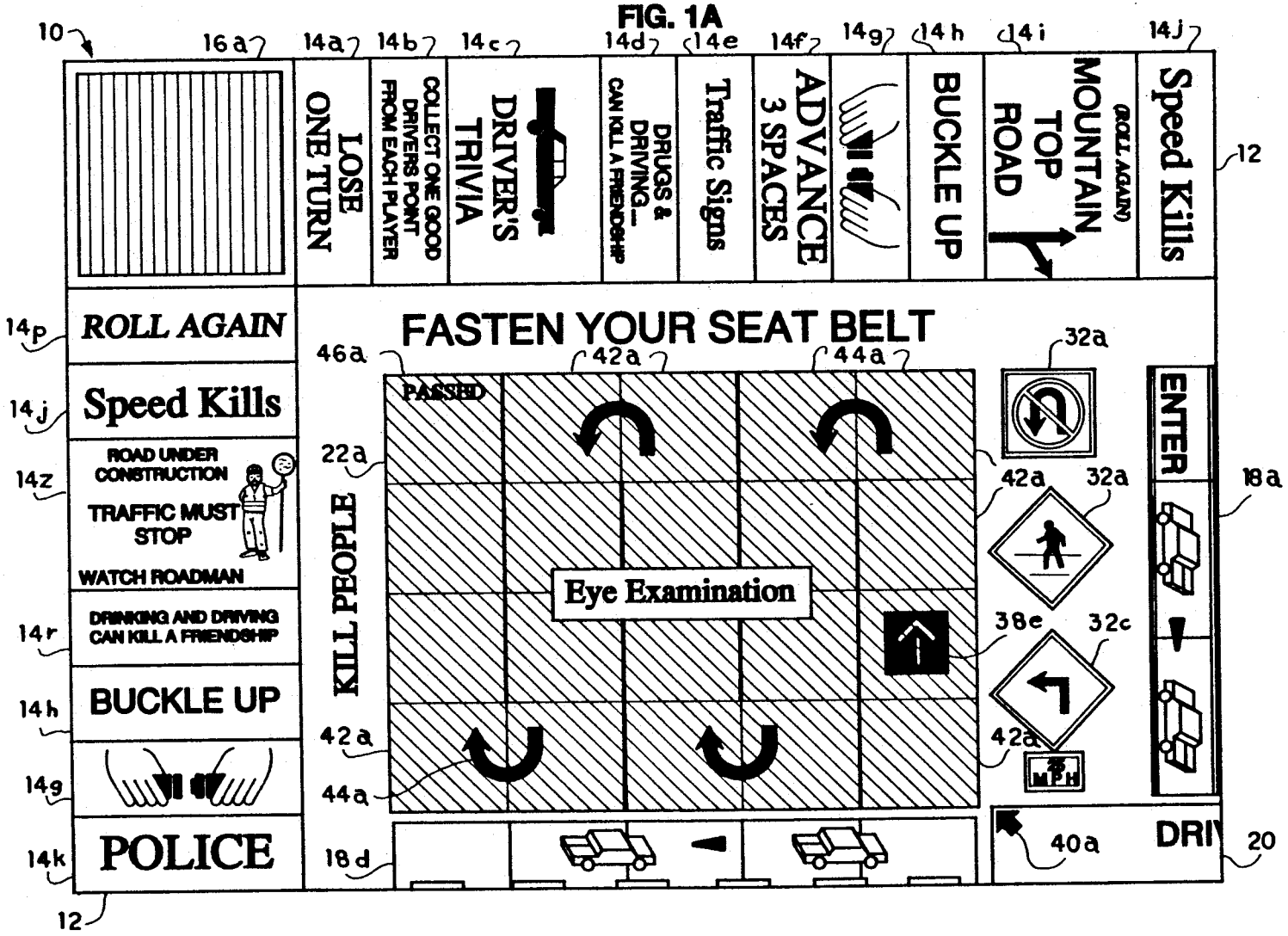
FIG. 1A is a view of the upper left or first quadrant of the game board of the present invention.
Figure 1B:
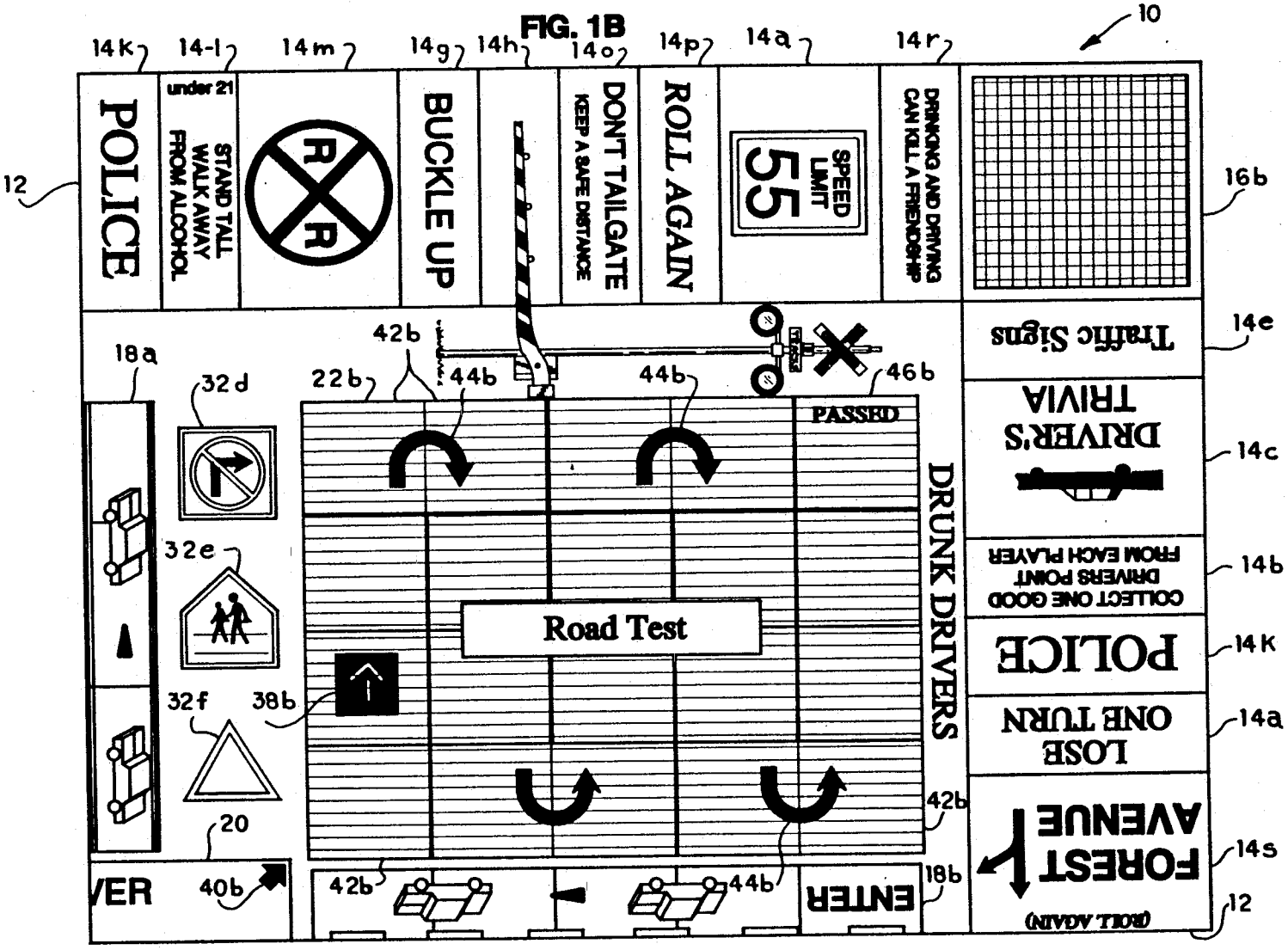
FIG. 1B is a view of the upper right or second quadrant of the game board of the present invention.
Figure 1C:
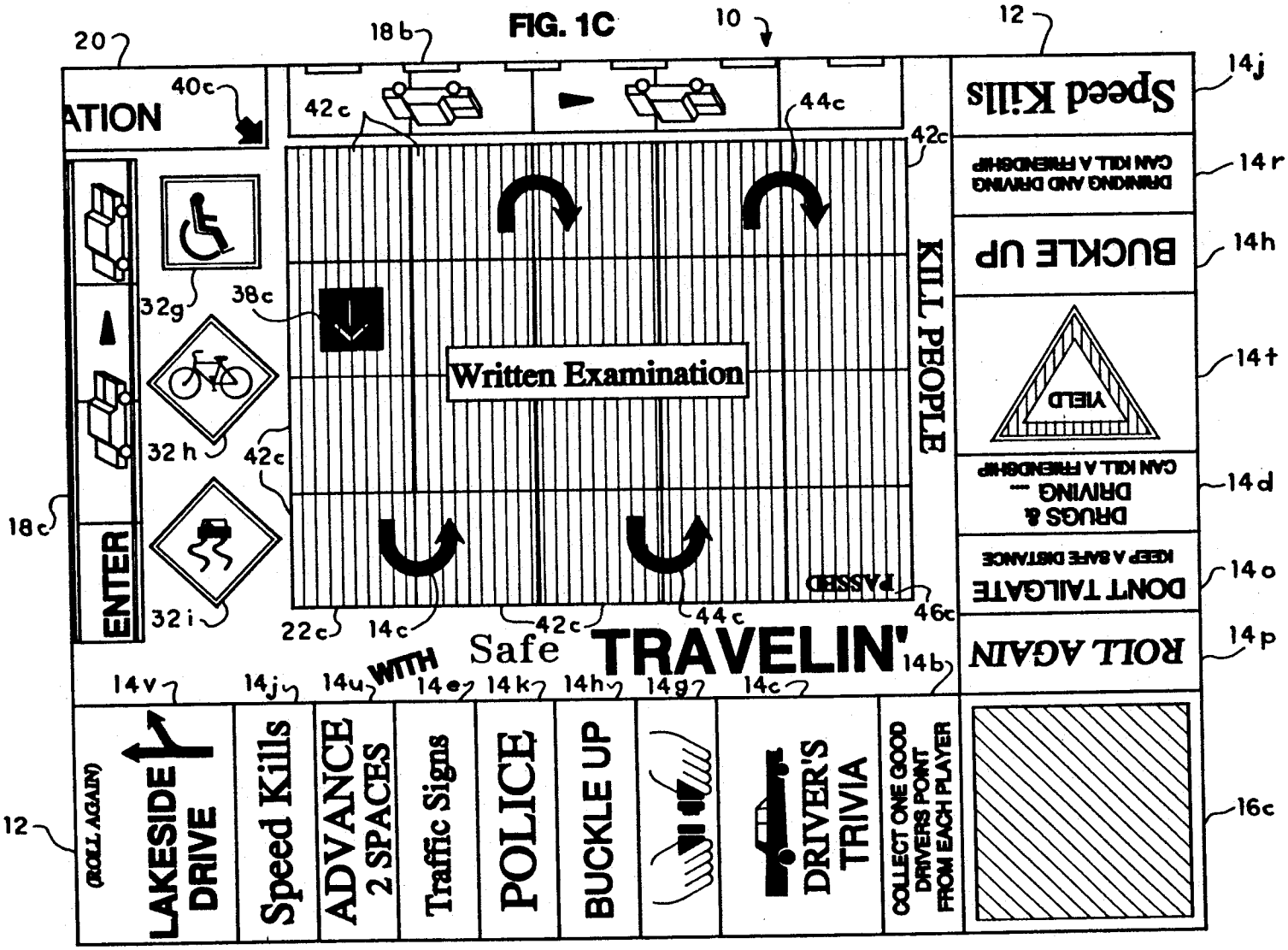
FIG. 1C is a view of the lower right or third quadrant of the game board of the present invention.
Figure 1D:
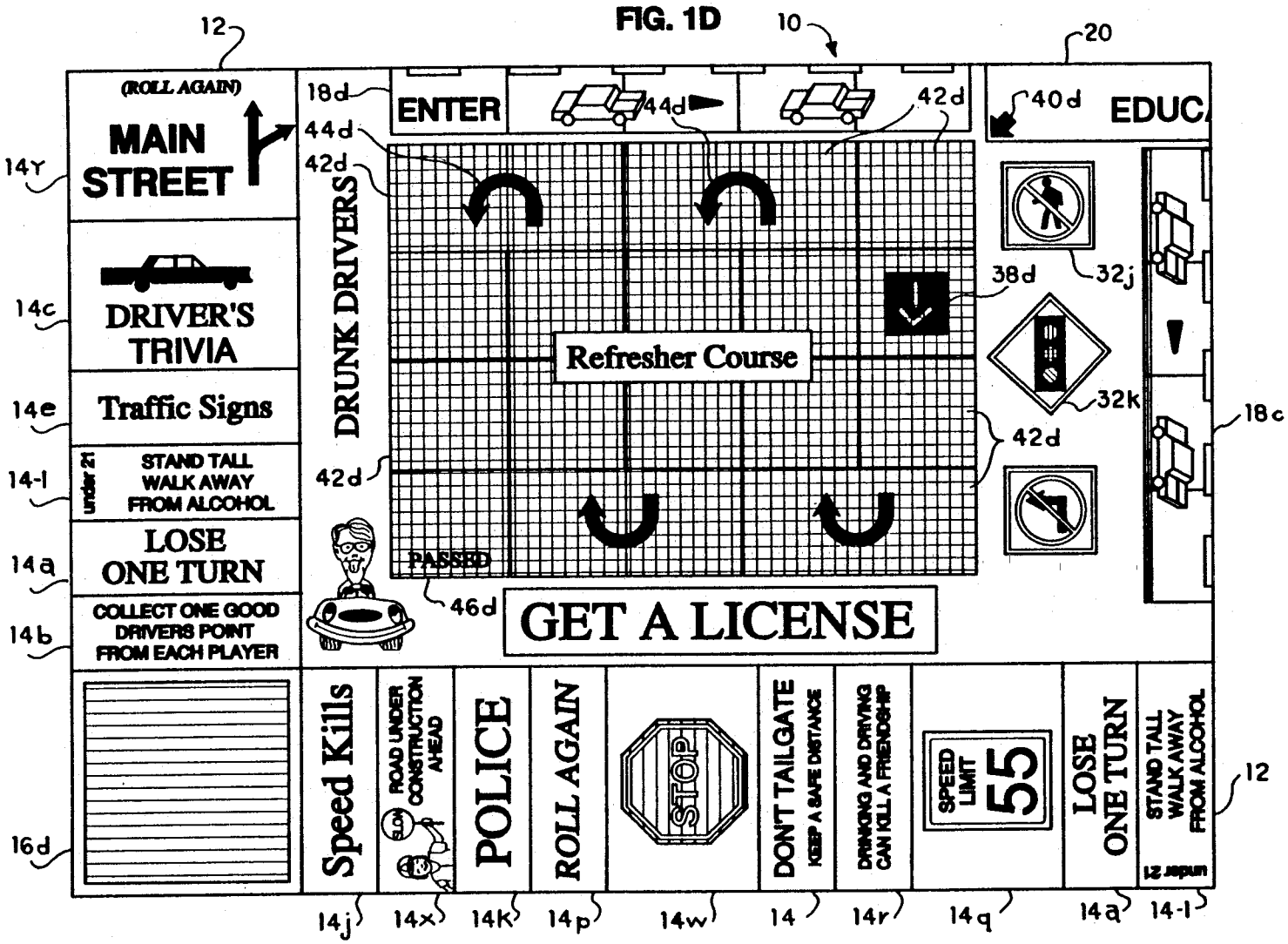
FIG. 1D is a view of the lower left or fourth quadrant of the game board of the present invention.

Referring now particularly to FIGS. 1A through 1D of the drawings, the present invention will be seen to relate to a board game for teaching various aspects of driver education, and a method of play thereof. The present board game includes a generally rectangular game board 10 of FIGS. 1A through 1D, with the quadrants of the game board arranged in a clockwise manner from the first through the fourth quadrants respectively in FIGS. 1A through 1D. Game board 10 includes a peripheral playing path 12 comprising a plurality of different linearly arranged playing positions or spaces 14*a* through 14*z*. It will be seen that many of these different positions 14*a* through 14*z* repeat one or more times around the peripheral playing path 12 of board 10, while others may appear only once. Other types of player positions may be added, some of the present player positions 14*a* through 14*z* may be deleted, and/or two or more of the player positions 14*a* through 14*z* may be rearranged on the board 10, without departing from the spirit of the game of the present invention. In addition to the above peripheral player positions 14*a* through 14*z*, four corner positions 16*a* through 16*d* are provided, beginning with corner 16*a* of FIG. 1A and continuing in a clockwise direction with corners 16*b*, 16*c*, and 16*d* respectively in FIGS. 1B, 1C, and 1D.

In addition to the peripheral playing path 12 described above, game board 10 also includes a series of playing paths 18*a* through 18*d* extending from the midpoint of each of the four peripheral sides inward to the "Driver Education" block 20 in the center of the board 10. These four paths 18*a* through 18*d* will be seen to form a cruciform shape, with the "Driver Education" block 20 at the center of the four playing paths 18*a* through 18*d* and at the center of the board 10.

Each of the four quadrants of board 10 also contains a playing field or "test site" within the peripheral playing path 12. These four playing fields or sites 22*a* through 22*d* provide further travel for each player position marker passing therethrough, and are used to simulate an eye or vision examination (field 22*a*), road test (field 22*b*), written examination (field 22*c*), and refresher course or remedial training (field 22*d*). However, the above examinations or tests are not necessarily taken in the clockwise order in which they appear on the board 10. Preferably, the vision or eye test field 22*a* must first be taken, followed by the written examination field 22*c*. Finally, the road test field 22*b* must be completed, with the refresher or remedial training course 22*d* accomplished as required during the course of play. The above order of play and order of fields 22*a* through 22*d* on the board 10, assures that any player who completes each of the above fields 22*a* through 22*c* (and 22*d* as required) will have completed more than one lap of the playing path 12 of board 10, thus tending to even out the chance elements with the increasing number of individual plays or moves. The precise path of play and other details of the board 10 will be described further below in a discussion of the rules and method of play of the game.

Figure 2:
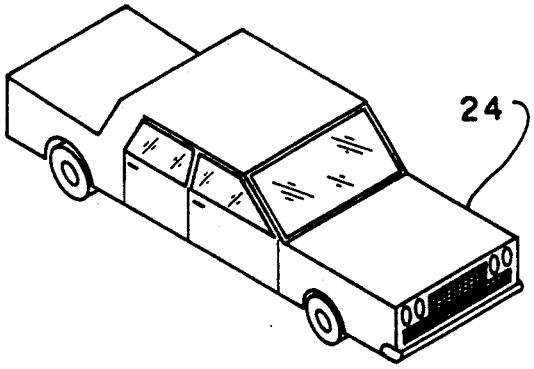
FIG. 2 is a perspective view of a player position marker used in the play of the game of the present invention.

FIG. 2 represents one possible configuration of a player position marker 24 which may be used by the players to traverse and mark their positions on the playing paths of board 10 during the course of the game. While an automobile-like configuration is shown, it will be understood that other configurations may be used. Preferably, a plurality of markers 24 will be provided in different colors for the different players of the present game.

Figure 3:
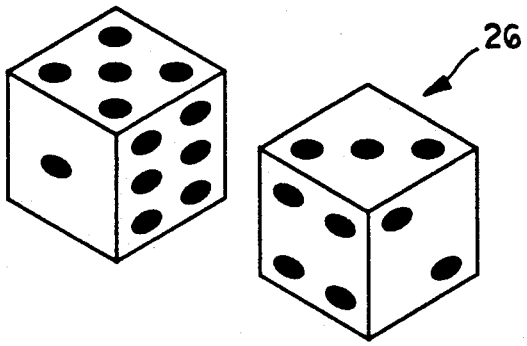
FIG. 3 is a perspective view of dice providing chance means in the course of play of the present game.

The magnitude of each player's move is determined by chance means, such as the dice 26 shown in FIG. 3 of the drawings. Dice 26 provide for some additional variations in the play of the present game (e. g., rolling "doubles"), but other chance means may be used if desired.

The present game is intended for play by from two to four players. The description of the play of the present game described below will assume that four players are involved. However, it will be seen that additional players may be accommodated by means of additional player position markers 24 with slight modifications to the game board 10, and possibly additional cards such as those shown in FIGS. 4A through 6C and described further below. The object of the present game is to be the first player to complete successfully the respective test and traverse (1) the vision or eye test field 22*a*; (2) the written examination field 22*b*; (3) the road test field 22*c*; and (4) (if required according to the rules of play)

the refresher course or remedial training field 22d. A player successfully completing the tests and traversing fields 22a through 22c is awarded a card as will be described further below. The first player to collect one each of the three cards is considered to have successfully completed each of the above steps required for a driver's license under the rules of the present game, and is the winner of the game.

Immediately before the start of the game, each of the players will select a player position marker 24 of the color of their choice (e.g., red, yellow, green, or blue). Each of the various player position markers 24 is then placed upon the corner 16a, 16b, 16c, or 16d having a corresponding color, as respectively indicated by the red, yellow, green, and blue coded shading of corners 16a through 16d of FIGS. 1A through 1D. The various colors of portions of the board 10 also serve as the vision or eye test portion of the game, as will be described further below. In the event two or more players desire the same color of player marker 24, the dice 26 may be used to determine the holder of the given player marker 24 by each player rolling the dice and awarding the use of the given player marker to the player coming closest to a predetermined number (highest or lowest total, etc.). It will be seen that the location of the various "test sites" or fields 22a through 22d around the board 10 and the four legs 18a through 18d of the cruciform playing route or path, will tend to even out any advantage a player might initially have by starting near one of the given fields or sites 22a through 22d.

The chance means or dice 26 are then rolled to determine which of the players moves first, with the player having the highest number moving first, the second highest moving second, etc. It will be seen that this method of determining the order of play further randomizes the play of the game to further eliminate any potential or inherent advantage a given player might have if play were to proceed in the order of the corner positions 16a through 16d around the perimeter 12 of the board 10. The players will move their playing pieces along the playing paths of the board 10 according to the order of play determined as above.

Early in the play of the game, each player is attempting to enter the "eye examination" test site or field 22a, as this test must be completed before any of the others. In order to do so, however, the player must complete his or her move as designated by the chance means or dice 26, so as to end up on one of the positions 14i, 14s, 14v, or 14y, thereby allowing the player to immediately roll the dice 26 again to determine a further move along the entry road 18a. If the final position 14a through 14z of the player marker 24 is beyond one of the entry positions 14i, 14s, 14v, or 14y on that move, the player must continue to advance his or her player position marker around the perimeter positions 14a through 14z of the board 10 until he or she has another opportunity to "turn in" to another of the entry lanes or paths 18a through 18d; the reversal of direction or "backing up" of a player position marker is not permitted. There are other restrictions and considerations to travel on any of the cruciform playing roads or paths 18a through 18d, as will be discussed further below.

However, before attempting to turn in toward the center of the board 10, as discussed above, each player must traverse at least a portion of the peripheral playing path 12 and abide by the instructions of whichever given player position 14a through 14z upon which his or her player position marker comes to rest at the end of a given move. For example, a player starting from the red corner position 16a and moving two places would end up on position 14b, marked "collect one good drivers point from each player" in the form of a card 28. An example of such a card 28 is shown in FIG. 5A of the drawings. No penalty is imposed upon other players not having such cards 28 to provide in accordance with the instruction of position 14b, but it will be seen that the accumulation of good drivers points or awards as represented by card 28, can be of value in the course of the game.

Figure 4A:
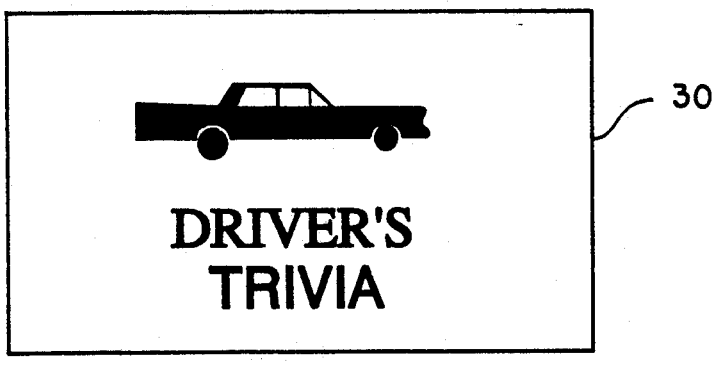
FIG. 4A is a view of the front side of a "Driver's Trivia" card used during the course of play of the present game.

A player landing upon the "Drivers Trivia" position 14c, must draw a card 30 as shown in FIG. 4A. The opposite side of each of these cards 30 contains a question to be answered by the player. The questions are generally along the lines of those found on drivers license written examinations in most states, e.g., identifying traffic signs; identifying hand signals; answering questions relating to emergency situations, traffic offenses and penalties, and other problems; etc. A player who incorrectly responds to a question or problem on one of the Drivers Trivia cards 30 is not penalized, but if the response is correct, the player is awarded one good driver point card 28, which may be held until needed.

Space or position 14e, "Traffic Signs," requires the player landing thereon to attempt to identify all twelve traffic signs 32a through 321 adjacent the two opposite inward paths 18a and 18c. As in the case of the response to a "Drivers Trivia" card 30 described above, a correct response is rewarded with a card 28 representing one good driver point; an incorrect response is not penalized.

Other spaces, such as the "Advance 3 Spaces" position 14f, as well as positions 14a ("Lose One Turn"), 14p ("Roll Again") and 14u ("Advance 2 Spaces"), are treated according to the instructions in that respective space when a player position marker 24 comes to rest upon one of those respective positions 14a, 14f, 14p, or 14u. However, in addition to the "Roll Again" space 14p, a player may gain an additional roll of the dice 26 by first rolling a total of ten on the dice, comprising two fives ("55"). This recognition of the basic national speed limit provides a second roll of the dice 26. Additional spaces, such as 14d ("Drugs and Driving"), 14g and 14h (Seat belt symbol and "Buckle Up"), 14j ("Speed Kills"), 14l (("Speed Limit 55" sign), 14r ("Drinking and Driving"), and 14x ("Road Construction Ahead") are essentially "filler" spaces, providing further messages in keeping with the spirit and purpose of the present game, but requiring no action on the part of the player other than the advancement of his/her position marker onto or over those spaces during the course of play.

Figure 4B:
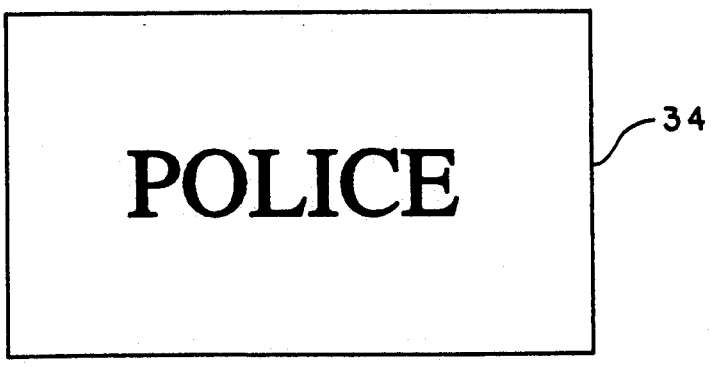
FIG. 4B is a view of the front side of a "Police" card used during the course of play of the present game.

However, several other spaces require specific action according to the rules of play. When a player finishes a move on a space or position 14k ("Police") for example, that player is required to draw a "Police" card 34 (the front of which is shown in FIG. 4B) from the stack provided and respond according to the instructions or message on the reverse face of the card 34. Police cards 34 may contain safety tips; messages relating to traffic violations and/or penalties therefor; notifications of violations committed and requiring the player to receive one or more "Driving Violation/bad driving point" card(s) 36 (FIG. 5B); etc.

Other spaces requiring specific action on the part of a player are space 14m (railroad crossing symbol) and 14n

(crossing gate). When a player encounters these spaces, the player must announce that he/she is coming to a full stop and waiting until the train has passed and the gate is up before proceeding with the remainder of the move. A player failing to comply with the above requirement is then required to proceed to the next nearest corner space 16 of the board, forfeit one turn, and receive one "Bad Driving Point" card 36. If a player commits such a violation causing him/her to forfeit a turn While that player has received a second consecutive turn for a previous action, the player must forfeit the second turn but will be allowed to play subsequently in the normal order of play.

The "yield" sign of peripheral space 14*t* and the "Stop" sign of space 14*w* require similar responses from a player encountering those spaces 14*t* and/or 14*w*. In the case of the "yield" sign 14*t*, the player must announce that he/she is slowing and/or stopping and yielding to other traffic before proceeding. In the case of the "Stop" sign 14*w*, the player must announce that he/she is coming to a full stop and allowing other traffic to pass before proceeding. The penalties for failing to act as above are the same as those for incorrectly acting at a rail crossing sign or gate 14*m* or 14*n*, described above.

The last peripheral space or position 14 requiring action on the part of a player (other than spaces 14*i*, 14*s*, 14*v*, and 14*y*, which spaces provide for a player to enter the central area of the board 10 and will be discussed below) is space 14*z* ("Road Under Construction . . . "). The requirement and penalty for failing to act as required are the same as those for transiting the "Stop" sign space 14*w* discussed above.

As briefly discussed above, a player must pass the examinations and pass through the test sites for at least the eye examination, written examination, and road test, in that order, before winning the game. Thus, the initial object of each player is to terminate a move on one of the positions 14*i* ("Mountain Top Road"), 14*s* ("Forest Avenue"), 14*v* ("Lakeside Avenue"), or 14*y* ("Main Street") to thereby allow that player to make another move along the respective path 18*a*, 18*b*, 18*c*, or 18*d* leading to the central Driver Education block 20 and thence to the appropriate examination block. There are two methods of entering the appropriate examination area: (1) a player must roll a number of moves allowing that player to terminate his/her move directly upon the Driver Education block 20 in the center of the board 10 and then enter the appropriate area on his/her next move, or (2) the player must roll a total of ten, comprising two fives ("55") on the dice 26. If a player on one of the routes 18*a* through 18*d* is unable to accomplish either of these two methods, he/she must wait until his/her next turn to make another attempt. A player rolling a "55"is allowed to place his/her marker 24 directly upon one of the directional arrow blocks 38*a* through 38*d* located respective in each of the test sites or fields 22*a* through 22*d*.

Another feature of the present game which adds interest and further reinforces a good driving habit, is the requirement for players to announce that they are signalling for their turns from peripheral spaces 14*i*, 14*s*, 14*v*, or 14*y* onto the respective inward path or route 18*a*, 18*b*, 18*c*, or 18*d*. A player failing to announce that he/she is signalling for the turn, is penalized in accordance with the penalties for failing to announce a full stop where appropriate, as described further above. Thus, the penalties provided for in various parts of the present game, serve to reinforce good habits and to penalize bad habits, just as in the case of the real driving world.

The following description will assume a player wishes to enter the central area of the board 10 and pass through the area or test site 22*a* provided for the "eye examination" portion of the present game, and that the player has terminated a move with his/her playing marker 24 resting upon the position space 14*s*, or "Forest Avenue" space. The player may then make another roll of the dice 26 to determine the number of spaces inward he/she may move toward the central Driver Education block 20, and must announce that he/she has actuated his/her turn signal to make the turn. If the player fails to roll double fives with the dice 26, and also fails to roll a total number permitting the player to terminate the move directly upon the central Driver Education block 20, the player must continue to attempt to roll a proper number when his/her turn comes up in the order of play.

When the player rolls a number Which provides for the termination of the move on the central Driver Education block 20, the player may move his/her marker 24 along the right side of the playing path or lane 18*b* (FIG. 1B) inward from the "Forest Avenue" position 14*s*. Upon reaching the Driver Education block 20, the player marker is positioned upon the diagonal entrance arrow 40*a* pointed toward the "Eye Examination" test site or field 22*a*. Other diagonal directional arrows 40*b*, 40*c*, and 40*d* direct the player(s) respectively toward fields or sites 22*b*, 22*c*, and 22*d*. Alternatively, if the player rolls a "55," his/her position marker 24 is placed upon the directional arrow block 38*a* two places into the field or site 22*a*.

At this point, the player must pass the "Eye Examination" test before proceeding further. This is accomplished when the player successfully identifies the four colors of the corner positions 16*a* through 16*d*, in order around the board. (It will be noted that the fields or sites 22*a* through 22*d* may also be color coded, either with the same color as the corresponding corner position 16*a* through 16*d* of that particular quadrant of the board 10, or alternatively may be colored in contrasting colors as shown.) When a player has successfully identified the colors, that player continues to roll the dice and correspondingly move his/her position marker 24 along the playing path within the "Eye Examination" site 22*a*, defined by the positions 42*a* and the directional arrows 44*a*. Positions 42*b*, 42*c*, and 42*d*, and arrows 44*b*, 44*c*, and 44*d*, are respectively located in fields or sites 22*b*, 22*c*, and 22*d*. When the player leaves the "Eye Examination" site 22*a* at the "Passed" position 46*a* (with "Passed" positions 46*b*, 46*c*, and 46*d* correspondingly provided for sites 22*b*, 22*c*, and 22*d*), the marker is moved diagonally directly to the corresponding corner (16*a* in this case) and moved clockwise along the peripheral playing path 12 until completing the proper number of moves or spaces. The player is also provided with an "Eye Examination Passed" card 48 (FIG. 6B), which is retained by the player until the end of the game.

The general procedure for taking the written test of field or site 22*c* and the road test of site 22*b* are identical to the procedure for the "Eye Examination" described above, with the exception of the tests themselves. In the case of the written examination of site 22*c*, the player must turn away from the game board 10 and correctly write down or list two safety slogans (e.g., "Drugs and Driving Can Kill a Friendship," "Buckle Up," etc.) and any two of the traffic signs 32*a* through 321, 14*m*, 14*t*, 14*q*, or 14*w* which appear on the board 10. The player is given a maximum of four minutes to accomplish the above, and must achieve a score of 75% (three of the four answers must be correct) in order to advance. When the player has successfully responded to the above "test," he/she receives a "Written Examination Passed" card 50 (FIG. 6A), which is held until the end of the game. In the event the player fails the test, he/she can observe the board 10 and make another blind attempt (i.e., turned away from the board) on his/her next turn. The player may not advance until passing the test, as in the case of other tests involved in the course of play of the present game. In the case of the "Road Test" portion of the game, the player must merely traverse the field or test site 22*b* in accordance with the flow directed by the arrows 40*b*, 38*b*, and 44*b* to receive a "Road Test Passed" card 52 and thereby win the game; as noted above, the first player to accumulate one each of the cards 48, 50 and 52, is declared the winner of the game.

However, it will be noted that the present game provides ample opportunity for the collection of one or more "Driving Violation" cards 36, each of which has a value of one "Bad" Driving point, somewhat similar to the system commonly used by States in determining the standards of driving by licensed drivers according to the number and type of violations of which they have been convicted. According to the rules of the present game, if a player accumulates eight or more "Bad" points (i.e., eight or more cards 36), then that player is automatically removed from the game. That player's position marker 24 and any other cards 28, 36, 48 and/or 50, must be returned to the common area provided for such.

In order to avoid such an occurrence, the present game provides for the removal of adverse or "Bad" points by means of the "Refresher Course" of field or site 22*d*. When a player accumulates a net total of four or more "Bad" points and accompanying cards 36, that player is required to proceed directly to the central Driver Education block 20 and place his/her marker on the diagonal entrance arrow 40*d* for the Refresher Course 22*d*. The player must then complete the course in the manner described above for the other courses 22*a*, 22*b*, and 22*c*. No additional actions are required, but it will be seen that the requirement for taking the Refresher Course of site 22*d* effectively removes a player from the course of the game and potential access to the other test sites and accumulation of cards 48, 50, and 52 required to win the present game. Accordingly, an astute player will make every attempt to keep from accumulating any more "Bad" points and cards 36 than absolutely necessary. The completion of the Refresher Course of field or site 22*d* described above provides another means for ridding oneself of "Bad" cards 36, as two such points and cards may be returned to the common area when a player completes the refresher course.

Accordingly, a game is provided Which may be used for relaxation and enjoyment by the players thereof, and further to teach and remind those players of the laws, rules and regulations relating to automobile traffic and driving. It is to be understood that the present invention is not limited to the sole embodiment described above, but encompasses any and all embodiments within the scope of the following claims.

I claim:

1. A method of playing a driver education board game, comprising the following steps:

providing a generally rectangular game board having four sides, four corners of different colors, four quadrants, a peripheral playing path formed of a plurality of peripheral playing positions providing instruction relating to motor vehicle operating practices and the playing of the game, a midpoint playing position on each of the four sides and a corner playing position at each of the corners, four inwardly directed playing paths having playing positions thereon and extending from the midpoint playing position of each side of the game board to a central area, a test site located in each of the four quadrants of the game board and having a playing path extending from the central area to one of the corners and comprising a plurality of playing positions therein, with each midpoint playing position providing access to one of the inwardly directed playing paths and the inwardly directed playing paths providing access to each of the test sites and a plurality of traffic signs thereon;

further providing player position markers in the colors of the corner positions for the players, chance means for the determination of moves of the player position markers by the players, and a plurality of driver's trivia cards, police cards, good driver's award cards, driving violation cards, and examination passed cards;

choosing a player position marker for each player, placing each player position marker on a corner position having a color matching that of the player position marker, and determining an order of play for the players by using the chance means;

manipulating the chance means and using the result to determine the magnitude of the move, moving the player position marker for the first player to the peripheral position corresponding to the result obtained by manipulating the chance means, and responding to the instructions on the peripheral position upon which the move is terminated;

further manipulating the chance means and thereby providing for entrance to one of the inwardly directed playing paths and thence to one of the test sites;

successfully responding to the requirements of the test site, passing therefrom to the peripheral playing path, and collecting a card confirming the passage of the test of that test site; and continuing in the above manner with each of the players alternatingly taking turns until a player collects three different test passage cards from each of three different test sites, thereby winning the game.

2. The method of claim 1, further including the step of:

making a verbal announcement of a proper driving action when such action is indicated by the instructions along the playing paths.

3. The method of claim 1, further including the steps of:

providing a game board having an eye examination test site, a written examination test site, and a road test site; and requiring each player to successfully complete the passage of an eye examination, a written examination, and a road test and collect a card for each examination in that order, in order to win the game.

4. The method of claim 1, further including the step of:

acquiring at least one driving violation card and accompanying negative point according to the rules of play of the game.

5. The method of claim 4, further including the steps of:

providing a refresher course test site on the game board, and;

requiring a player to complete the refreshed course upon acquiring four driving violation cards and accompanying negative points during the course of play of the game.

6. The method of claim 1, further including the step of:

acquiring at least one good driver's award card and accompanying positive point according to the rules of play of the game.

7. The method of claim 1, further including the step of:

providing a pair of dice as chance means.

8. The method of claim 7, further including the step of:

rolling the dice and producing a result of five on each of the dice, and allowing the player a second consecutive turn as a result.

9. The method of claim 7, further including the step of:

rolling the dice and producing result of five on each of the dice, and allowing the player to proceed directly to a test site from another position on the game board as a result.

* * * * *